United States Patent [19]

Thackston

[11] Patent Number: 4,875,528

[45] Date of Patent: Oct. 24, 1989

[54] TORQUE CONTROL ACTUATOR

[75] Inventor: Clyde D. Thackston, Columbia, S.C.

[73] Assignee: Allen-Bradley Company, Inc., Columbia, S.C.

[21] Appl. No.: 310,277

[22] Filed: Feb. 13, 1989

[51] Int. Cl.[4] ..... B25B 23/14

[52] U.S. Cl. ..... 173/12; 192/150

[58] Field of Search ..... 173/12, 15; 81/470, 81/467; 192/150

[56] References Cited

U.S. PATENT DOCUMENTS

| | | | |
|---|---|---|---|
| 2,964,151 | 12/1960 | Eckman | 173/12 X |
| 3,059,620 | 10/1962 | Eckman | 173/12 X |
| 3,082,742 | 3/1963 | Vilmerding et al. | 81/470 |
| 3,242,996 | 3/1966 | Wright et al. | 173/12 X |
| 3,515,251 | 6/1970 | Clapp | 173/12 X |
| 3,766,990 | 10/1973 | Eckman et al. | 173/12 |
| 3,811,513 | 5/1974 | Wezel et al. | 173/12 |
| 4,154,308 | 5/1979 | Goldsberry et al. | 173/12 |
| 4,631,992 | 12/1986 | Eckman | 81/470 |

*Primary Examiner*—Frank T. Yost
*Assistant Examiner*—James L. Wolfe
*Attorney, Agent, or Firm*—Quarles & Brady

[57] ABSTRACT

A pneumatic tool has a torque control actuator which shuts off the tool upon the attainment of a predetermined operating torque. A wrap spring clutch which has a torque capacity at the operating torque has an input shaft and an output shaft. A first axially engageable element rotates with the output shaft and a second element can be axially engaged to rotate with the first element. A cam socket rotates with the clutch input shaft and cams on a cam surface of the first element in response to relative angular movements between the clutch input and output shafts. The cam socket is biased so as to move the first and second elements out of engagement and a pressure operated air valve is provided which moves the cam socket against its bias to engage the first and second elements when the tool is operated. When the operating torque is reached, the cam socket cams off a ledge of the cam surface to allow the air valve to move to a closed position where the tool is shut off. The tool operator then releases the pressure tending to close the valve and the cam socket bias returns the air valve to its initial axial position and cams the cam socket to its initial axial and angular positions to be ready for the next operation of the tool. A secondary clutch is also provided to protect against overloading the actuator components.

8 Claims, 4 Drawing Sheets

TORQUE CONTROL ACTUATOR

BACKGROUND OF THE INVENTION

1. Field of the Invention

This invention relates to a torque control actuator device for providing an axial movement for actuating a control device in response to a predetermined torque.

2. Discussion of the Prior Art

Power driven rotary tools for tightening fasteners are well known. Often times, these tools are constructed to tighten a workpiece, typically a fastener such as a nut or bolt, to a predetermined torque. In that case, the operator engages the tool with the workpiece and operates the tool until the torque is reached. In some tools, a clutching mechanism between the prime mover and the fastener engagement of the tool begins to slip so as to stop driving the fastener when the predetermined torque has been reached.

In such tools, it is important to turn the tool off, preferably automatically, as soon after the predetermined torque has been reached as possible. Otherwise, although the fastener has stopped, the prime mover continues exerting a reactionary torque on the operator and causing wear to the internal components of the tool. Turning the tool off quickly helps prevent fatigue of the operator, signals the operator that a fastening operation has been completed and reduces wear of the tool components.

SUMMARY OF THE INVENTION

The invention provides a torque control actuator which is adaptable to conventional clutching mechanisms to rapidly effect actuation of a control function. The actuator has a clutch which includes an input shaft to be driven by a prime mover, an output shaft for driving a workpiece and means connecting the input shaft to the output shaft to rotationally drive the output shaft with the input shaft below the torque capacity of the clutch. At output torques above the torque capacity, the output shaft can slip relative to the input shaft.

The actuator also has first and second rotary engagement means with the first means coupled to rotate with the output shaft. The first and second engagement means are axially slidable relative to one another so that they can be moved into and out of engagement with one another. The second means has a cam surface defined thereon. The cam surface has a ledge facing axially away from the first means, a leg portion extending from an end of the ledge toward the first means and an inclined return portion axially opposed from the leg and ledge and extending axially away from the leg and ledge from the angular position of the leg to the angular position of the ledge. A cam means is rotatively driven at the speed of the input shaft and is connected to the second rotary engagement means so as to cam on the cam surface of the second rotary engagement means. An axially moveable control for effecting a desired operation in response to the axial movements and means for translating axial movements of the cam means to the control are also provided.

The actuator also includes means for biasing the cam means, the second rotational engagement means, the translating means and the control to an initial position in which the second rotary engagement means is out of engagement with the first rotary engagement means. Releasable means are provided for axially moving the control, the translating means, the cam means and the second rotary engagement means against the force of the biasing means in response to operation of the prime mover.

Upon initial operation of the prime mover below the torque capacity of the tool, the moving means urges the cam means from the initial position to a second position in engagement with the ledge of the cam surface to engage the first and second rotary engagement means and hold them in engagement so that they both rotate with the output shaft. This axial movement of the cam means, the control and the intermediate parts may or may not be used to effect any desired function. The cam means slides off the ledge into the leg to move axially relative to the second rotary engagement means when the output shaft slips relative to the input shaft due to the attainment of the torque capacity of the tool. Through the translating means, this axial movement of the cam means allows the control to move to a third axial position, which desirably effects a desired function.

Release of the moving means allows the biasing means to return the cam means, second rotary engagement means, translation means and control to the initial position, whereupon the cam means cams on the return portion of the cam surface to angularly align the cam means with the ledge of the cam surface in the initial position. This actuator operates extremely rapidly, is simple in construction and is independent of the relative angular positions of the clutch input and output shafts.

In a preferred form, means are provided for coupling the second rotary engagement means to the output shaft to rotate with the output shaft below a second predetermined torque transmitted from the second means to the output shaft when the first and second rotary engagement means are engaged. This coupling means allows the second rotary engagement means to slip relative to the output shaft when the torque to which the second rotary engagement means is subjected exceeds the second predetermined torque. This protects against any overloading of the components of the actuator which may otherwise occur because of the inertial forces to which the actuator can be subjected. In an especially useful form, this coupling connects the first rotary engagement means to the output shaft, thereby connecting the second rotary engagement means to the output shaft when the first and second means are engaged.

It is therefore a principal object of the invention to provide a torque control actuator which operates rapidly to produce an axial motion for actuation in response to a relative angular movement.

It is another object to provide such a torque control actuator which is insensitive to the relative angular position between clutch input and output shafts and is adaptable for use with many different types of torque control clutches.

It is another object of the invention to provide such an actuator which is automatically reset.

It is another object of the invention to provide such an actuator which can be economically manufactured.

These and other objects and advantages of the invention will be apparent from the drawings and the detailed description.

DETAILED DESCRIPTION OF THE PREFERRED EMBODIMENT

Figure 1:
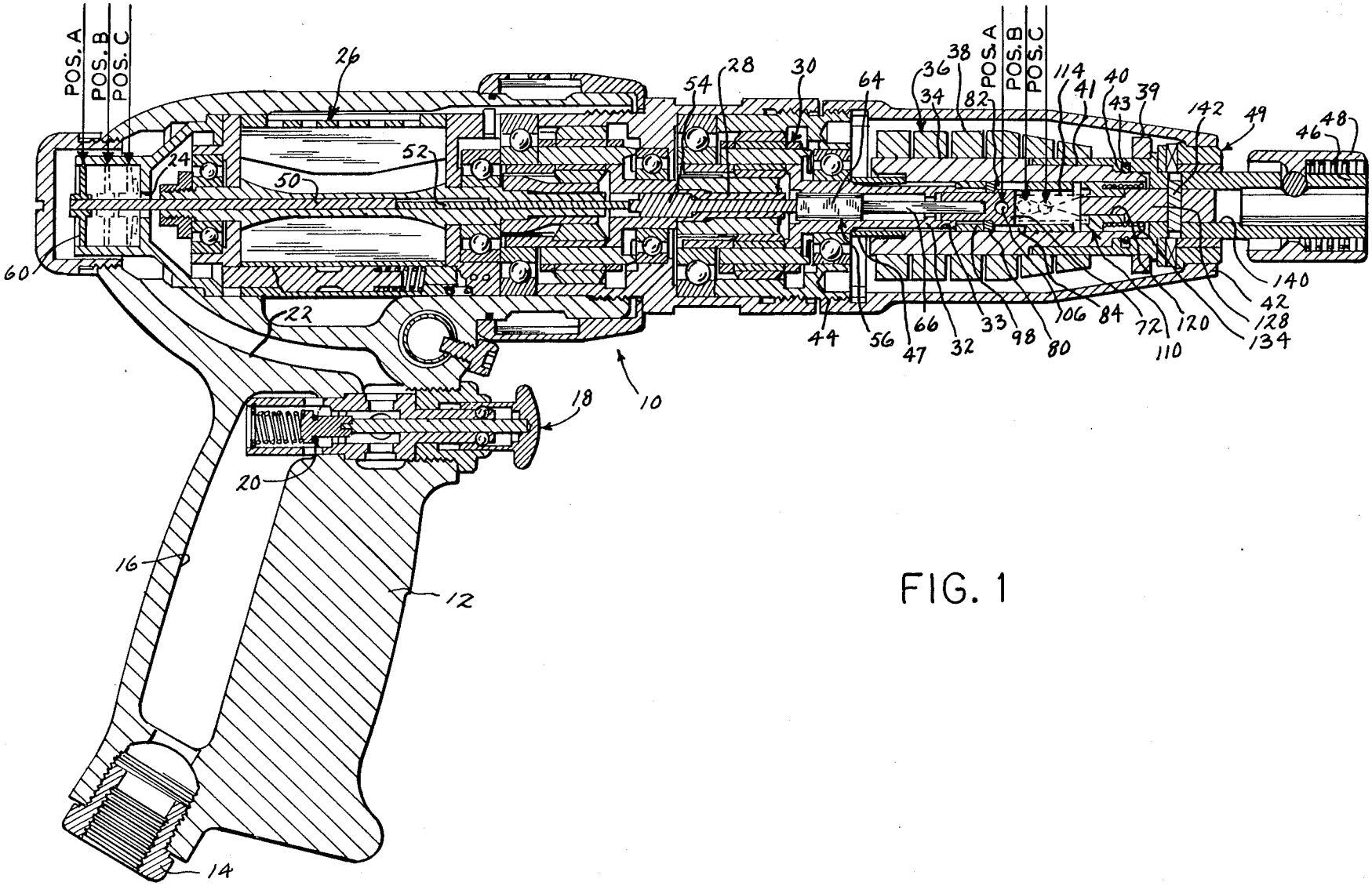
FIG. 1 is a sectional view of a tool incorporating a torque control actuator of the invention.

Referring to FIG. 1, an air operated nut driver 10 incorporating a torque control actuator of the invention is disclosed. The nut driver 10 has a handle 12 and an air inlet 14 at the base of the handle which is suitable to be connected to a source of compressed air. Compressed air is admitted to a duct 16 defined inside the handle 12 and to the supply side of a trigger valve 18 which is adapted for operation by an operator of the tool 10. In the extended position shown in FIG. 1, the valve 18 vents duct 22 to atmospheric pressure. When the valve 18 is depressed by an operator, the vent is closed, seal 20 of the valve 18 is unseated, and compressed air is admitted through duct 22 defined in the tool 10 housing and opening 24 to power a sliding vane type air motor 26. The air motor 26 has a quill shaft 28 which rotationally drives a two stage planetary gear reduction train 30. All of the parts 12–30 heretofore described are conventional and well known in the art.

Figure 3:
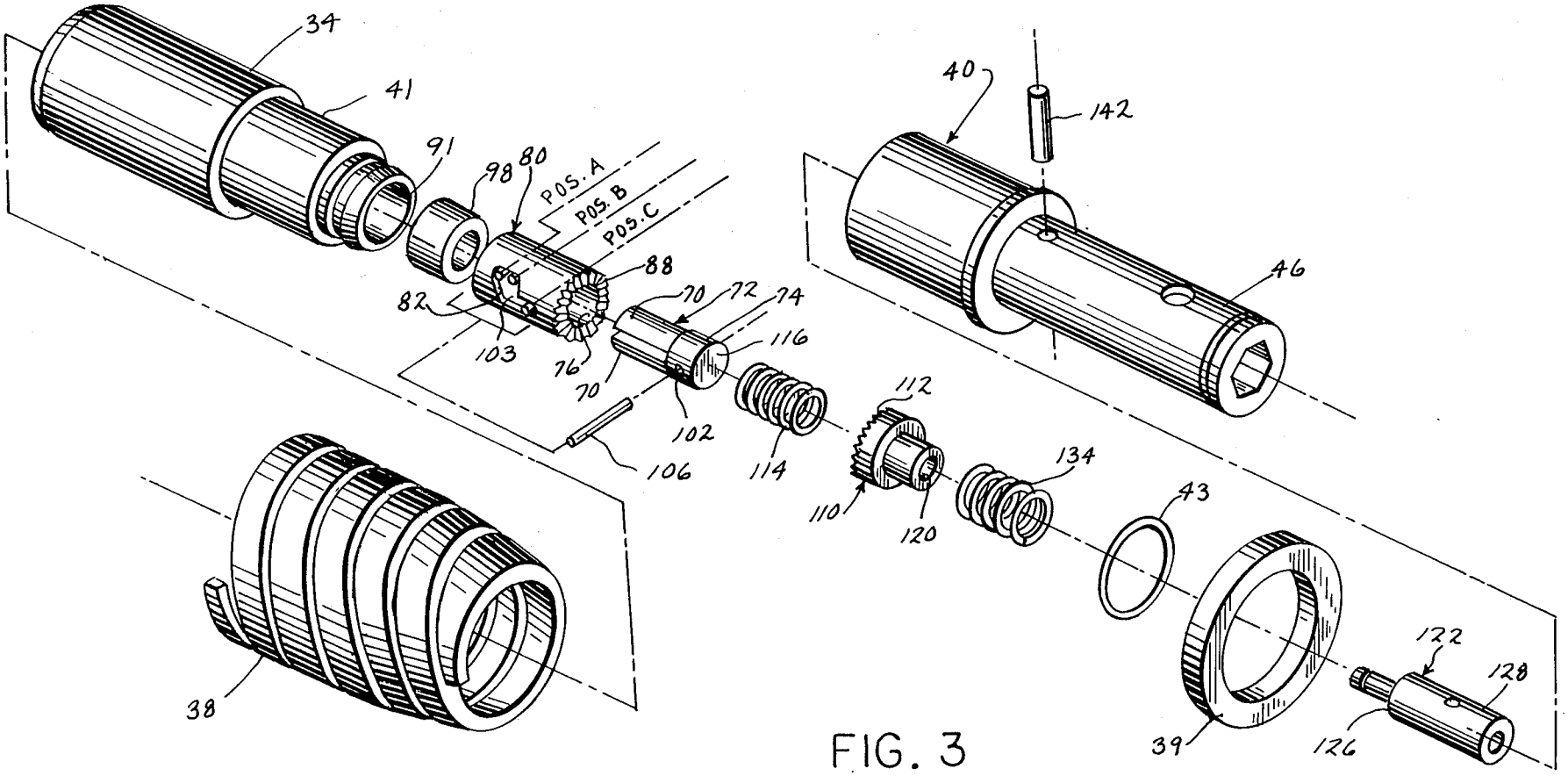
FIG. 3 is an exploded perspective view of several of the parts shown in FIG. 2.
Figure 2:
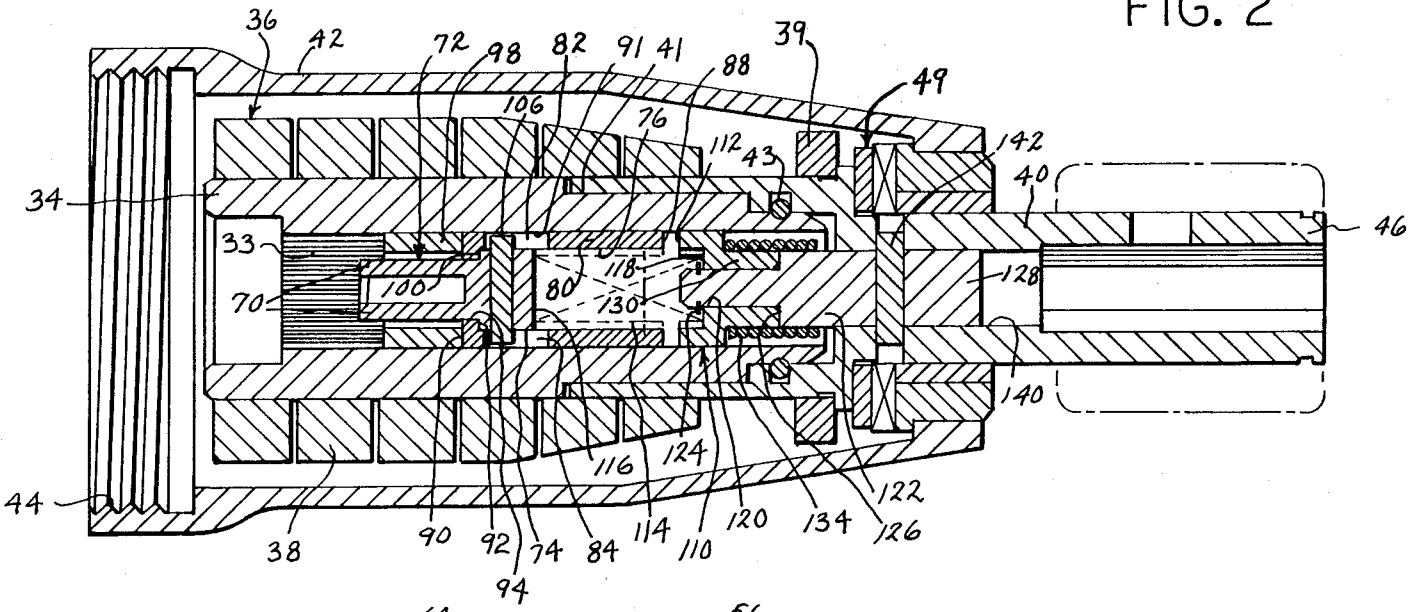
FIG. 2 is a detail view of a portion of the tool of FIG. 1.

The gear train 30 has an output shaft 32 which is in rotary driving engagement with a tubular input shaft 34 of a clutch 36 via an interior splined portion 33 (FIGS. 1 and 2) of the input shaft 34. Referring also to FIG. 3, the clutch 36 has a torque control spring 38 which is in frictional engagement with the outside diameter of the input shaft 34 and is in frictional engagement with the outside diameter of a tubular output shaft 40. The output shaft 40 extends outside of clutch housing 42, which is fixed at 44 to the tool housing and has an end 46 which is adapted to mount and drive a suitable workpiece engaging socket 48 (FIG. 1). The output shaft 40 is mounted on a forward, reduced diameter portion 41 of the input shaft 34 with a sliding fit so as to be free to rotate relative to the input shaft 34 but for the control spring 38 and is held axially with respect to the input shaft 34 by a suitable retaining ring 43. The clutch 36, including the shafts 34 and 40 and the control spring 38 are axially captured between an axially stationary spacer 47 and a bearing 49 which is axially fixed in the end of clutch housing 42.

Referring to FIG. 3, the normal forward rotation of the tool 10 is, as viewed from the left end of the clutch 36, clockwise. From left to right in FIG. 3, the control spring 38 is wound clockwise as viewed from the left end. As such, the reactionary torque forces exerted on the spring 38 by the input shaft 34 driving the output shaft 40 through the spring 38 tend to unwind the spring 38. This tendency causes the spring 38 to expand in diameter thereby allowing the output shaft to slip relative to the input shaft 40 when a predetermined operating torque which is to be exerted on the workpiece is attained.

An adjustment washer 39 may be provided around the outside of the output shaft 40. The adjustment washer 39 may be slid axially on the output shaft 40 to push the forward end of the spring 38 backwardly on the shaft 40 to thereby reduce the frictional engagement force of the spring 38 on the shaft 40. The frictional engagement force may be increased by pushing the spring 38 forwardly from its rearward end to increase the amount it overlaps the output shaft 40.

Referring to FIG. 1, a series of push rods extends from rearward of the opening 24, through the opening 24, through the air motor quill shaft 28, through the planetary gear train 30 and inside of the input shaft 34. From the left as viewed in FIG. 1, this series of rods includes a valve stem 50, intermediate push rods 52 and 54, and a rotationally driven push rod 56. The valve stem 50, intermediate rods 52 and 54 and driven rod 56 are axially slidable so as to provide a continuous rod train for translating axial movements between the forward end of the push rod 56 and a valve 60 at the rearward end of the valve stem 50. The push rod train in the preferred embodiment is made up of multiple rods to allow for variations between specific tools 10, although it should be understood that the push rod train could be a single rod or any number capable of translating the axial movements discussed below.

Figure 5:
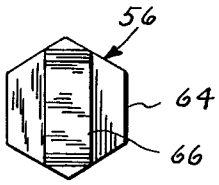
FIG. 5 is an end plan view of the push rod shown in FIG. 4.
Figure 4:
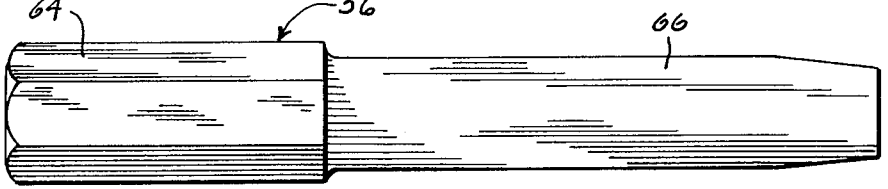
FIG. 4 is a side elevation view of a push rod component of the tool of FIG. 1.

Referring to FIGS. 1, 4 and 5, the push rod 56 has a hexagonally shaped portion 64 and a flattened portion 66. The internal periphery of the planetary output shaft 32 is hexagonally shaped to receive the portion 64 in rotationally engaged, axially sliding contact. Thus, the push rod 64 is driven in rotation at the speed of the input shaft 34 by the planetary output 32 but can slide axially relative to the planetary output 32.

Figure 6:
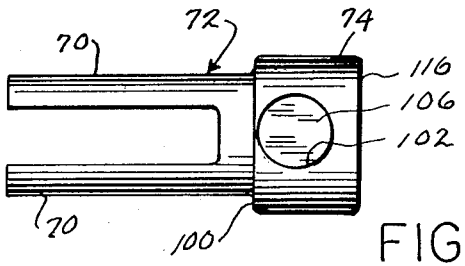
FIG. 6 is a side elevation view of a cam socket component of the tool of FIG. 1.
Figure 7:
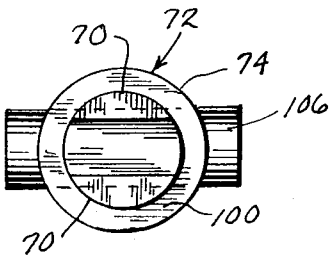
FIG. 7 is an end plan view of the cam socket of FIG. 6.

The flattened portion 66 of the push rod 56 is received between prongs 70 of a cam socket 72 (FIGS. 6 and 7). The forward corners of the portion 66 are relieved to be easily slid between the prongs 70 during assembly. By virtue of the mating flat surfaces of the prongs 70 and the portion 66, the push rod 56 and the cam socket 72 rotate together.

Figure 8:
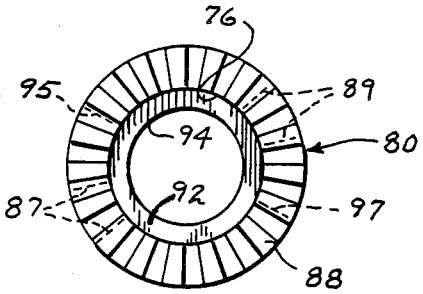
FIG. 8 is an end plan view of a rotary engagement element of the tool of FIG. 1.
Figure 9:
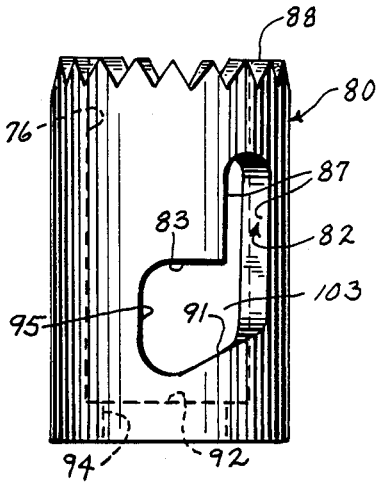
FIG. 9 is a side elevation view of the rotary engagement element of FIG. 8.
Figure 10:
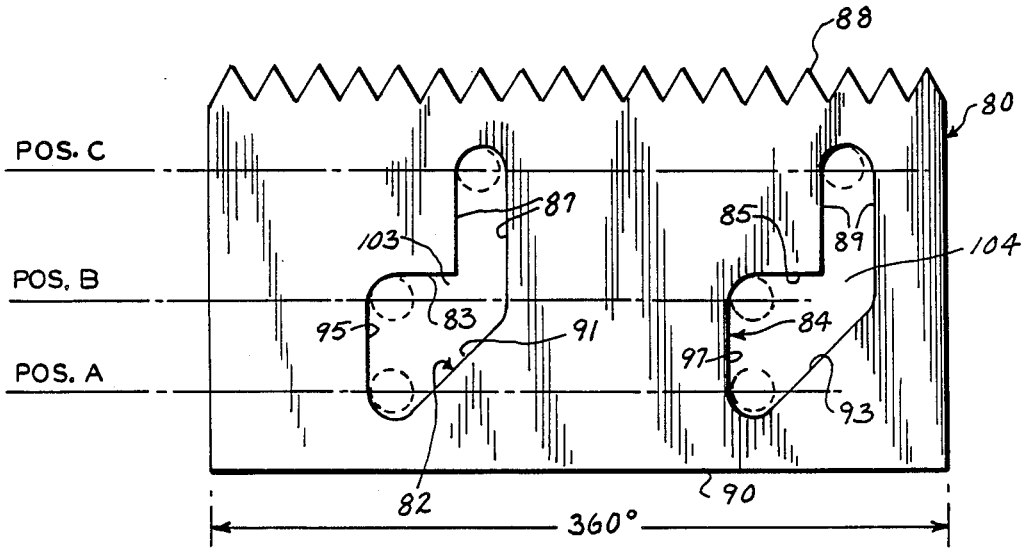
FIG. 10 is a global side elevation view of the rotary engagement element of FIG. 8 unwrapped for purposes of illustration to show its full 360° extent.

The cam socket 72 has an enlarged cylindrical head 74 which is received in sliding engagement in an internal bore 76 of a cylindrical rotary engagement element 80. Referring to FIGS. 8, 9 and 10, the side walls of the rotary engagement element 80 define cam surfaces 82 and 84. The rotary engagement element 80 also has a forward toothed end 88 and a rearward flat end 90. At the flat end 90, the internal bore 76 terminates in a shoulder 92 which defines a smaller bore 94 through which the prongs 70 extend.

The cam surfaces 82 and 84 define respective openings 103 and 104 and have respective ledge surfaces 83 and 85, leg portions 87 and 89, and return surfaces 91 and 93. Corresponding surfaces and portions of the cam surfaces 82 and 84 are disposed 180° apart from one another. The leg portions 87 and 89 are disposed at the end of the respective ledges 83 and 85 and extend from the ledges forwardly. The side of each leg portion 87, 89 which is opposite from the corresponding ledge 83, 85 extends rearwardly from the axial position of the corresponding ledge to the respective return surface 91, 93. The return surfaces 91, 93 are each inclined rearwardly from the angular location of the corresponding leg portion 87, 89 to the angular location of the corresponding ledge surface 83, 85. Each return surface 91, 93 is joined with a radius at its rear extremity with a respective forwardly extending guide surface 95, 97, which is joined at its forward extremity with a radius to the corresponding ledge surface 83, 85.

The rotary engagement element 80 is axially spaced from the end of the splined portion 33 of the input shaft 34 by a spacer 98 and is received in bore 91 of input shaft 34 in a sliding fit. The shoulder 92 of the rotary engagement element 80 seats against shoulder 100 of cam socket 72 to limit rearward motion of the cam socket 72.

The cam socket 72 has a bore 102 into which a pin 106 (FIGS. 2, 3, 6 and 7) is pressed or otherwise securely received. The ends of the pin 106 extend beyond the head 74 of the cam socket 72 and are received within openings 103 and 104 defined by respective cam surfaces 82 and 84 of the rotary engagement element 80. The cam socket 72 is therefore rotatable to a limited extent determined by the pin 106 and cam surfaces 82 and 84 relative to the rotary engagement element 80. In FIG. 1, the cam socket 72 is shown rotated 90° relative to the rotary engagement element 80 for clarity of illustrating the various positions of the cam socket 72.

Another rotary engagement element 110 has a rearward toothed end 112 which mates in rotationally engaged contact with the toothed end 88 of rotary engagement element 80 when the elements 80 and 110 are pushed axially together. A compression spring 114 resides between end 116 of cam socket 72 and a rearward face 118 (FIG. 2) of the rotary engagement element 110. The compression spring 114 biases the socket 72 and rotary engagement element 110 apart thereby also biasing the rotary engagement element 110 and rotary engagement element 80 apart. However, when the ends 88 and 112 of the rotary engagement element 80 and rotary engagement element 110, respectively, are pushed together, the rotary engagement element 80 and rotary engagement element 110 rotate together. Although mating teeth are shown in the preferred embodiment to provide rotational engagement between the elements 80 and 110, it should be understood that any suitable disengageable rotary coupling could be used.

The rotary engagement element 110 is received in a sliding fit within the bore 91 of the input shaft 34. The rotary engagement element 110 has a bore 120 therethrough through which extends an overload arbor shaft 122. The rotary engagement element 110 is captured axially on the overload arbor shaft 122 by a suitable clip 124 at the end of the arbor shaft 122 and by a shoulder 126 defined by a larger diameter 128 of the arbor shaft. The larger diameter portion 128 of the arbor shaft 122 is approximately the same diameter as the adjacent portion 130 of the rotary engagement element 110.

An overload clutch spring 134, which is wound in the same direction as the control spring 38, restrains the rotary engagement element 110 from rotating relative to the overload arbor shaft 122. However, when the element 110 and shaft 122 are driven in the forward direction discussed above, the spring 134 is only effective to transfer torque from the element 110 to the shaft 122 until a certain predetermined overload torque is met or exceeded. At that point, in a manner similar to that of the control spring 38 discussed above, the spring 134 releases the overload arbor shaft 122 so that it may rotate relative to the rotary engagement element 110, such as may be the case when the shaft 122 is stopped and the element 110 is rotating with the input shaft 34 as the input shaft 34 decelerates.

The overload arbor shaft 122 extends beyond the input shaft 34 and into a bore 140 of the output shaft 40. A drive pin 142 extends through and beyond the overload arbor shaft 122 and into holes in the output shaft 40 so that the overload arbor shaft 122 and the output shaft 40 are fixed to one another to rotate together. Thus, the rotary engagement element 110 is coupled to the output shaft 40 to rotate with the output shaft below the overload torque limit which is transmittable from the element 110 to the arbor shaft 122.

Operation

With a source of compressed air applied to the air inlet 14 but with the trigger valve 18 not depressed, atmospheric pressure is in the duct 22 as a result of the vent provided by the trigger valve 18. At atmospheric pressure, the spring 114 biases the cam socket 72 and therefore the push rod train, including push rod 56, intermediate rods 52 and 54, and valve stem 50 to their fully rearward positions. In this resting or initial position, referred to as position A in FIGS. 1, 3 and 10, the valve 60 is fully unseated to allow a flow of compressed air to the air motor 26 when the trigger 18 is depressed.

Depressing the trigger 18 closes the vent to duct 22 and allows compressed air to flow past the valve 60 and power the air motor 26. The flow of compressed air past the valve 60 creates a pressure differential across the valve 60 which causes the valve 60 to move to position B illustrated in FIGS. 1, 3 and 10, thereby compressing the spring 114 via the valve stem 50, intermediate rods 52 and 54, push rod 56 and cam socket 72. Valve 60 is stopped at position B when pin 106 contacts ledges 83 and 85 of the respective cam surfaces 82 and 84, and pushes the end 88 of the rotary engagement element 80 into engagement with the end 112 of rotary engagement element 110. In this position, the rotary engagement element 80 rotates with the rotary engagement element 110, which rotates with the fastener being fastened via the output shaft 40, the pin 142, the overload arbor shaft 122, and the overload clutch spring 134.

At the same time that the cam socket 72 moves to position B, thereby moving the rotary engagement element 80 into engagement with the rotary engagement element 110, the air motor 26 begins to turn which drives the input shaft 34 via the planetary gear train 30 as previously described. The input shaft 34 transmits torque through the torque control spring 38 to the output shaft 40 until the operating torque limit of the clutch 36 is reached. This limit corresponds to the desired torque to which the workpiece is tightened and the output shaft 40 at that limit begins to turn relative to the input shaft 34 because of the slippage allowed by the torque control spring 38. At that time, the rotary engagement element 80 is still in engagement with the rotary engagement element 110 and therefore turning with the workpiece, which is decelerating or has stopped. Since the cam socket 72 rotates with the input shaft 34, however, the cam socket 72 begins rotating relative to the rotary engagement element 80 at that time.

The relative rotation between the cam socket 72 and the rotary engagement element 80 slides the ends of the pin 106 off of the ledges 83 and 85 into the leg portions 87, 89. Once the pin 106 is fully in the leg portions 87, 89, the air pressure differential exerted on the valve 60 moves the cam socket 72 axially forward relative to the rotary engagement element 80 to position C illustrated in FIGS. 1, 3 and 10. In this position, the push rod 56, intermediate rods 52 and 54, valve stem 50 and valve 60 have moved to their fully forward positions where the valve 60 closes the air passageway 24, thereby cutting off the flow of air to the motor 26, which terminates its operation.

When the trigger 18 is released at the end of the fastening operation, the supply of compressed air to duct 22 is cut off and the residual pressure in passageway 22 acting on valve 60 to keep it closed is vented to atmosphere through the vent provided by the trigger valve 18 returning to its extended position and compression spring 114 moves valve 60 via the cam socket 72 and push rod train 56, 54, 52 and 50 to position A. This axial movement also causes pin 106 to cam along return surfaces 91 and 93 of the respective cam surfaces 82 and 84 to rotate the rotary engagement means 80 relative to the cam socket 72 and thereby return the pin 106 to the initial position A.

The action of the clutch 36 and of shutting off the valve 60 occurs extremely rapidly. It is so rapid that the inertia forces to which the cam socket 72 and rotary engagement element 80 are subjected makes it possible in some circumstances to shear the pin 106. The overload clutch spring 134 is provided to protect against shearing the pin 106. Should a high torque be exerted upon the rotary engagement element 80 by the pin 106, such as may be the case when the pin 106 slides off the ledges 83 and 85 when the operating torque has been reached, the torque exerted on the element 80 by the pin 106 will be transferred to the rotary engagement element 110, which will be allowed to slip, by the overload clutch spring 134, relative to the arbor shaft 122. Thereby, the pin 106 is protected from being sheared. However, in some applications it may be acceptable to rigidly secure the element 110 to the output shaft 40, if there is no danger of shearing the pin 106 or otherwise rendering the device inoperative.

A torque control actuator of the invention operates rapidly so as to turn off the torque experienced by the operator of the tool 10. Moreover, the actuator does not require any particular type of clutch. While a wrap spring type clutch like the clutch 36 is preferred, many other types of clutches (e.g. friction disc clutches) could be used. In addition, an actuator of the invention does not require for its operation that the the input and output shafts return to any particular angular orientation relative to one another. Regardless of the position of the output shaft relative to the input shaft after a torqing operation, the actuator automatically resets to its initial position to be ready for the next operation. It is also noted that an actuator of the invention allows reverse operation of the tool without the operation of the actuator.

Numerous modifications and variations to the preferred embodiment described will be apparent to those of ordinary skill in the art but will still be within the spirit and scope of the invention. For example, a torque actuated shut-off of the invention is not limited in application to air powered tools but could also be applied to electrical tools or any application where torque controlled actuation of a function is desired. Therefore, the invention should not be limited to the drawings or to the scope of the detailed description, but only by the claims which follow.

I claim:

1. A torque control actuator, comprising:

a clutch including:

(a) an input shaft adapted to be rotatively driven by a prime mover;

(b) an output shaft adapted to rotatively drive a workpiece; and (c) means connecting the input shaft to the output shaft to rotationally drive the output shaft in response to rotation of the input shaft below a first predetermined torque, said means allowing the output shaft to slip relative to the input shaft above the predetermined torque;

first rotary engagement means coupled to the output shaft to rotate with the output shaft;

second rotary engagement means axially slidable relative to the first rotary engagement means into and out of engagement with said first means, said second means having a cam surface defined thereon, said cam surface having a ledge facing axially away from the first means, a leg portion extending from an end of the ledge toward the first means and an inclined return portion axially opposed from the leg and ledge and extending axially away from the leg and ledge from an angular position of the leg to the angular position of an ledge;

cam means rotatively driven at the speed of said input shaft, said cam means being connected to the second rotary engagement means so as to cam on the cam surface of the second rotary engagement means;

an axially moveable control for effecting a desired operation;

means for translating axial movements of the cam means to the control;

means biasing the cam means, the second rotational engagement means, the translating means and the control to an initial position in which the second rotary engagement means is out of engagement with the first rotary engagement means; and releasable means for axially moving the control, the translating means, the cam means and the second rotary engagement means against the force of the biasing means in response to operation of the prime mover;

wherein:

(a) upon initial operation of the prime mover below the first predetermined torque exerted on the workpiece, the moving means urges the control, the translation means, the cam means and the second rotary engagement means from an initial axial position to a second axial position, said axial movement causing said cam means to abut the ledge of the cam surface and thereby engage the first and second rotary engagement means so that both said engagement means rotate with the output shaft;

(b) at operating torques at least as great as the first predetermined torque the output shaft slips relative to the input shaft and the cam means cams off the ledge into the leg to move axially relative to the second rotary engagement means to a third axial position, said axial movement allowing the control to move to a corresponding third axial position; and (c) release of the moving means allows the biasing means to return the cam means, second rotary engagement means, translation means and control to the initial position, whereupon the cam means cams on the return portion of the cam surface to angularly align the cam means with the ledge of the cam surface in the initial position.

2. A torque control actuator as in claim 1, further comprising means for coupling the second rotary engagement means to the output shaft to rotate with the output shaft below a second predetermined torque transmitted from said second means to the output shaft when the first and second rotary engagement means are engaged, said coupling means allowing said second rotary engagement means to slip relative to the output shaft when the torque to which the second rotary engagement means is subjected exceeds the second predetermined torque.

3. A torque control actuator as in claim 2, wherein the coupling means includes a torque control spring.

4. A torque control actuator as in claim 3, wherein the torque control spring couples the first rotary engagement means to the output shaft.

5. A torque control actuator as in claim 1, wherein the input shaft has an axial bore and the first and second rotary engagement means are disposed inside the axial bore.

6. A torque control actuator as in claim 1, wherein the means connecting the input shaft to the output shaft includes a torque control spring.

7. A torque control actuator as in claim 1, wherein the control is effective to turn off the prime mover in the third axial position.

8. A torque control actuator as in claim 7, wherein the prime mover is powered by compressed air and the control is a valve operative to turn off the flow of compressed air to the prime mover.

* * * * *

UNITED STATES PATENT AND TRADEMARK OFFICE

CERTIFICATE OF CORRECTION

PATENT NO. : 4,875,528

DATED : October 24, 1989

INVENTOR(S) : Clyde D. Thackston

It is certified that error appears in the above—identified patent and that said Letters Patent is hereby corrected as shown below:

In col. 8, line 25, change "of the leg to the angular position of an ledge;" to --of the leg to an angular position of the ledge;--.

Signed and Sealed this

Sixteenth Day of October, 1990

*Attest:*

HARRY F. MANBECK, JR.

*Attesting Officer*

*Commissioner of Patents and Trademarks*